United States Patent [19]

Schmid

[11] Patent Number: 4,599,920

[45] Date of Patent: Jul. 15, 1986

[54] POWER GRIP INSERT

[75] Inventor: Rainer Schmid, Eugene, Oreg.

[73] Assignee: Orthopedic Design, Inc., Eugene, Oreg.

[21] Appl. No.: 525,151

[22] Filed: Aug. 22, 1983

[51] Int. Cl.[4] ..... B25G 1/00

[52] U.S. Cl. ..... 81/489; 81/177.1; 81/177.3; 81/177.6

[58] Field of Search ..... 145/61 C, 61 D, 61 R

[56] References Cited

U.S. PATENT DOCUMENTS

| | | | |
|---|---|---|---|
| D. 19,522 | 12/1889 | Davis | 145/61 C |
| 271,303 | 1/1883 | Blaker | 145/61 C |
| 412,479 | 10/1889 | Davis | 145/61 C |
| 542,568 | 7/1895 | Miller | 145/61 R |
| 678,246 | 7/1901 | Hansel | 145/61 R |
| 1,503,251 | 7/1924 | Schoof | 145/61 C |
| 1,632,227 | 6/1927 | Halsey | 145/61 C |
| 2,088,008 | 7/1937 | Link | 145/61 C |
| 2,099,521 | 11/1937 | Herkimer et al. | 145/61 C |
| 2,104,129 | 1/1938 | Kress | 145/61 C |
| 2,205,769 | 6/1940 | Sweetland | 145/61 C |
| 2,757,694 | 8/1956 | Curtis | 145/61 R |

*Primary Examiner*—Frederick R. Schmidt
*Assistant Examiner*—J. T. Zatarga
*Attorney, Agent, or Firm*—Willian Brinks Olds Hofer Gilson & Lione Ltd.

[57] ABSTRACT

A power grip insert attachable to a handled instrument or to a user's hand, with one side contoured to accommodate the handle shank to be gripped, and an opposing side contoured in accordance with the musculature of hand palm. The palmar surface area includes dished areas for supporting the thenar and hypothenar eminences, and another depressed area into which the finger tips fit when clenching the instrument handle and grip insert together in the fist. Yet another contoured edge surface permits the thumb to close in cooperation with the fingers and effect a power grip around both the instrument handle and the grip insert.

7 Claims, 11 Drawing Figures

POWER GRIP INSERT

BACKGROUND OF THE INVENTION

The present invention generally relates to a hand grip, and more particularly relates to a hand grip contoured according to the muscle structure of the palm, and employed as in insert between the hand and the shank of the instrument to be gripped.

It is a well known practice to provide hand grips on various handles to obtain a comfortable feel as well as to reduce or eliminate the torsional movement between the handle and the hand of the user. Hand grips such as the type used on power tools or bicycle handle bars are contoured according to the finger surfaces to aid the user or rider in maintaining a firm grip on the handle.

U.S. Pat. No. De. 208,516 discloses a crutch handle grip design of solid structure used as an integral part of the crutch. The disadvantage of this approach is that each tool, or piece of sporting equipment to which the principal is applicable must be made with such a grip, and is thereby useful to only those persons with matching hand shapes and sizes.

U.S. patent application Ser. No. 354,198 filed Mar. 3, 1982 and assigned to the assignor of the present application is for a racing bicycle handle bar grip which generally conforms to the palm musculature to relieve median nerve pressure when the rider supports his upper body weight on the handle bars during extended riding excursions or races. These grips have an increased palmar surface area for distribution of such weight thereon and are not well suited for wrapping the fingers and the thumb around the combined grip and handle bar. Also, to prevent the grip disclosed in this application from rotating on the handle bar, the recessed curved area for receiving the tubular handle bar is angled so as to fit the curved part of the handle bar.

There is thus a need for a power grip insert for use with tools such as hammers, and sporting equipment such as golf clubs and tennis rackets which permit a user to clinch his fist around both the tool or the racket together with the power grip to optimize the gripping power between the hand and the handle shaft.

The fingers and thumb of a human hand, being jointed for movement, are well adapted for gripping objects. However, the palmar arch, the thenar and hypothenar musculature are not contoured to optimally conform to a tubular-like instrument shank. The need for a power grip fittable into a fist clenched around the shank of an instrument is even more evident in view that the flexing of the hand and finger muscles around the shank, in an effort to hold it firmly, only exacerbates muscle stress by reducing the conformance of the hand flesh to the tool. This serves only to increase muscle fatigue and strain on the median nerve located in the palmar area.

It is therefore a primary object of the present invention to provide a personal power grip insert with one surface particularly contoured according to the palm of the user's hand, and another surface for receiving the handle or shank of the instrument to be held.

It is another object of the invention to provide a power grip insert sized to conveniently fit into a fist clenched around the instrument shank, and fill the space between the shank and the dissimilar palmar contour of the user's hand.

Another object of the invention is to provide a power grip which particularly conforms to a user's hand, and which can be used on various tools and equipment with similar-sized handle shanks.

Still another object of the invention is to provide a power grip device adapted for permanent fastening to the instrument handle itself, to a glove or temporarily to the user's hand with a surgical-type adhesive.

It is yet another object of the invention to provide a power grip device which permits the shank of the instrument to be rotated by loosening the grip of the clenched fist, such as is necessary in changing from a forehand to a backhand grip on a tennis racket.

A further object of the present invention is to provide a grip insert with surface areas contoured according to the palm musculature with such muscles in the relaxed state.

Other objects and advantages of the invention will become apparent from the following detailed description when considered in connection with the attached drawings.

SUMMARY OF THE INVENTION

In accordance with the invention there is provided a grip insert which is attachable to and conforms to the user's hand, is constructed of a resilient material with one surface area adapted to conform to the palmar area musculature, and another surface area for receiving the handle shank of a tool or implement. The fingers and thumb of a hand clenched around a tool handle cause the resilient insert device to be further conformed therebetween and hence increase the gripping action.

The palmar contour of the insert conforms to the palm muscles when in a relaxed state and is thus adapted to fill in the voids between a handle and the palmar arch, the thenar eminence and hypothenar eminence and thereby optimize the comfort and ability of the human hand to grip a handled instrument. Another elongate dished area is provided for receiving the finger tips of a clenched fist to thereby enhance the gripping and holding power on the instrument handle.

In one form of the power grip insert an elastic or cloth strap is attached to it for strapping it to the user's hand. The grip insert is also adaptable for permanent attachment to a glove with an adhesive cement, or temporarily to a user's hand with surgical cement.

In another adaptation, a roughened area is provided on the insert in the shank-receiving area for optimizing the frictional grip between a handle shank and the grip insert.

DETAILED DESCRIPTION OF THE PREFERRED EMBODIMENT

Figure 1:
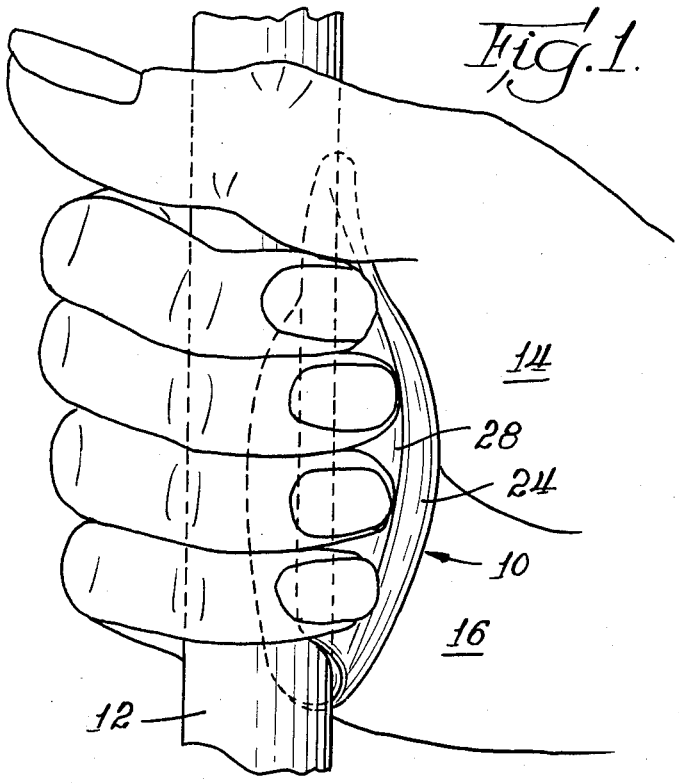
FIG. 1 is an isometric view showing the relative position of the power grip insert as it is held between a shaft handle and a hand clenched therearound.

The power grip device according to the invention is shown in FIG. 1 adapted to conform on one side thereof to the shape of a handle shaft 12, and on the opposing side thereof to the palmar area of the user's hand. From the outset, it should be understood that the device is illustrated and described in connection for use with the right hand, however, left hand grips can be constructed as mirror images of the embodiments shown.

Because the power grip device need not be made as part of the equipment handle grip, but rather as a separate grip, it can be specially contoured to conform to a person's hand to thereby optimize that person's individual grip on the handle shank. It should be appreciated that the palmar area of a human hand does not naturally conform to a cylindrical-like shaft when tightly gripped by the thumb and fingers. While the flesh of the palm area is pliable and is thereby forced to partially conform to a handle shaft when tightly gripped, the palm muscles are subjected to unnatural stresses when held in such a grip for extended periods of time. This not only creates muscle fatigue which may bring on cramps, but also causes pressure to be applied to the trunk of the median nerve, as well as its sensory branches, and may well result in very painful sensations to the user.

In accordance with one aspect of the invention the power grip device, when inserted between a handle shaft and the user's hand, provides a filler material therebetween such that the palmar muscles, comprising the thenar and hypothenar eminences, are not significantly distorted from their natural shape when a shaft handle is tightly gripped. In this manner, such muscles are subjected to less strain, less pressure is applied to the median nerve, and the hand as a whole undergoes less stress and fatigue during extended long gripping periods. As may well be appreciated, the power grip device can be constructed with palmar surface irregularities conforming to hand deformities.

As will be described in greater detail below, the various curvatures of the power grip device have been chosen to conform with the structure of a user's hand when in a nonstressed state. This is to be distinguished from a situation where a palmar form may be constructed by squeezing a putty-like material between an object and the hand. In this situation the stressed muscles, because of the squeezing action, undergo a certain degree of distortion and the resultant mold is not an optimized form for reducing fatigue and stress during power grip periods.

The power grip device is preferably constructed of a resilient material, such as a particulate cork and nylon composition, or a rubber type material. Of course, other materials may be ideally suited for special applications. For example, various types of rubber materials may be selected to reduce the effect of perspiration between the hand and grip device, or compositions which accentuate friction may be selected.

With the foregoing in mind, reference is made again to FIG. 1 where there is partially shown the thenar eminence 14, the hypothenar eminence 16 and the power grip device 10 with palmar surfaces (shown in FIG. 2) fitting snuggly thereagainst. Another general region of palmar contour for conforming to the tissue at the base of the thumb is shown at reference character 18 (FIG. 3). Yet another general region of curvature is indicated at 20 (FIG. 5) which area conforms to the palmar arch.

In order to firmly grasp an item by the hand the fingers and thumb must move in opposing directions creating a natural angular relationship between the thenar and hypothenar eminences. This angular relationship is generally independent of the size of the hand and corresponds to an angle of about 149 degrees. The angle thus created is shown by reference character 22 in FIG. 3. This edge of the hand grip device has on its palmar side a surface 26 (FIG. 2) also angled as before mentioned to mate with the thenar 14 and hypothenar 16 eminences as shown in FIG. 1.

On the shaft-receiving side and adjacent the mentioned edge there is provided (and shown in FIGS. 3 and 4) a concave surface 28 for comfortably receiving the finger tips. Because each finger has multiple knuckle joints, they are well-adapted for grasping objects and therefore do not require extensions of the power grip device into the phalange area thereof. As can be seen from FIG. 3 the finger tip area 28 is dished, and extends arcuately outwardly to accommodate the middle fingers of the hand which are longer than the index and little fingers. Significantly, the finger tip dished area 28 provides a surface area which can be pulled upon by the finger tips during gripping to enhance the squeezing action of the shaft-receiving area 36 onto the handle of the instrument. An edge 29 (FIG. 4) of the dished area 28, which is adjacent the shaft-receiving area 36, provides a shoulder against which the finger tips can also be pulled during gripping and thereby locked to prevent the handled instrument from being inadvertently released from the hand.

Figure 2:
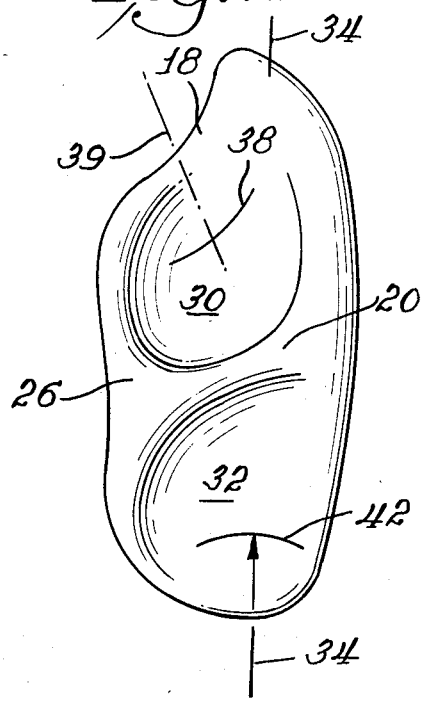
FIG. 2 shows the palmar surface of the power grip device with concave contours conforming to the thenar and hypothenar eminences.
Figure 3:
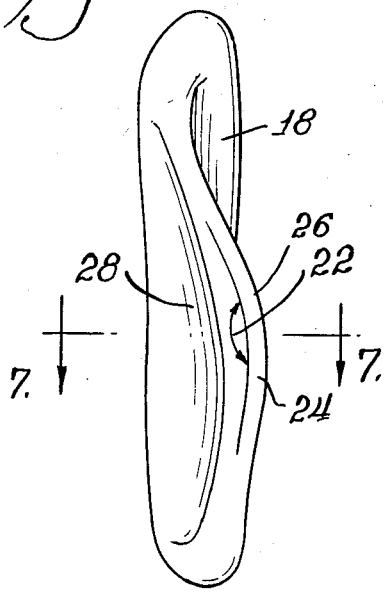
FIG. 3 is an edge view of the power grip device showing the angular relationship between the thenar and hypothenar eminences, and the dished area for receiving the finger tips as shown in FIG. 1.
Figure 4:
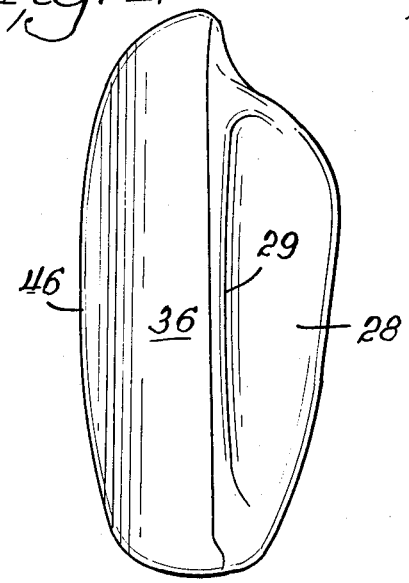
FIG. 4 is a view taken from the left side of FIG. 3, showing the area for accommodating a cylindrical handle shaft, and a side view of the finger tip area.
Figure 5:
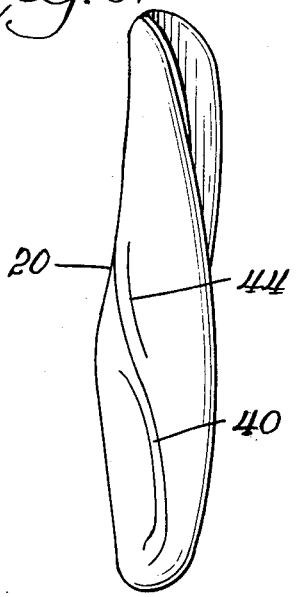
FIG. 5 is an edge view, opposite that of FIG. 3, showing the hypothenar depression in the palmar arch surface.

Another contoured surface of significant importance is that of the palmar arch 20 which is shown in FIGS. 2 and 5. FIG. 2 particularly illustrates the contoured depression 30 for supporting the thenar eminence 14, and the contoured surface 32 for supporting the hypothenar eminence 16. The raised area of the grip device bridging the thenar 30 and hypothenar 32 contoured areas, and comprising the palmar arch 20, has an angular relationship with respect to the axis 34 of the handle shaft receiving area 36 (FIG. 4) amounting to an acute angle of about 70 degrees. Because this palmar arch area 20 is so angled along the medial border of the thenar eminence, pressure on the median nerve is substantially reduced. Fatigue and muscle strain of the hand is correspondingly reduced, and the grip on tools or sporting equipment may be had without the attendant muscle stress and strain.

It should be realized that while the angular relationship between the palmar arch 20 and the shaft axis 34 is substantially independent of the hand size, the contoured depression areas 30 and 32 are heavily dependent upon the size and shape of the user's hand and should therefore be constructed or formed taking into consideration the size or age of the user.

In accordance with the various features and advantages of the invention the curvatures of the depressions are important for optimal performance and comfort of the hand grip device 10. For example, because of the semi-rounded shape of the thenar eminence muscles comprising the abductor pollicis brevis, oppenes pollicis, flexor pollicis brevis and abductor pollicis, a radius of about 47 mm along the radial arc designated 38 in FIG. 2 provides optimal comfort to the thenar eminence. This arc 38 defines the dished contoured area 30 which runs along the line 39 thereby creating a trough-like area. The line 39 is disposed about 25 degrees with respect to the axial axis 34 of the shaft-receiving area 36. Optimal comfort is obtained between the hypothenar eminence 16 and the corresponding dished curvature 32 by radial curvatures of about 50 mm and 80 mm corresponding respectively to arcs 40 (FIG. 5) and 42 (FIG. 2). Arc 40, which defines one dimension of the hypothenar contoured area 32, is subscribed in a plane parallel to the axial axis 34 of the shaft-receiving area 36. Arc 42, which defines a dimension transverse to the dimension defined by arc 40, is correspondingly subscribed in a plane transverse to the mentioned axial axis 34. These arcuate radii provide adequate contoured palmar area surfaces to accommodate the corresponding musculature of an adult of average hand size. It should be emphasized again that for optimal comfort the contoured areas of the grip insert are formed according to the measured curvatures of the user's hand in a relaxed state, rather than forming a mold by squeezing the hand around the combined insert and handle.

In FIG. 5 a side view of the palmar arch 20 is shown. For optimal support between this palmar arch 20 and the hand, the arch is shaped with a radius of about 145 mm as designated by radial arc 44.

Figure 7:
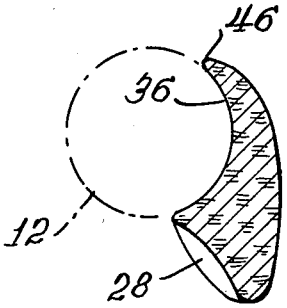
FIG. 7 is a cross-sectional view, taken along line 7—7 of FIG. 3, showing the contact surface between the shaft handle and the grip device.
Figure 6:
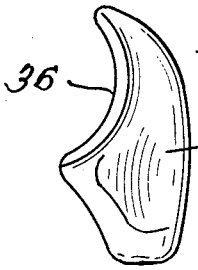
FIG. 6 is a top view of FIG. 3 showing the contoured surface area conforming to the base of the thumb.

The handle shaft-receiving area 36 of the power grip device 10 is shown in FIGS. 4 and 6 as being cylindrically shaped to conform to the tubular shape of a handled instrument. The general shape of the handle receiving area 36 can, of course, be formed to fit a variety of other sizes and shapes. Also shown in FIG. 6 there is the top view of the contoured surface 18 which conforms to that part of the hand where the base of the thumb joins the thenar eminence. The general contoured surface at this area permits the thumb to be bent at the first joint and thereby wrapped around both the power grip device 10 and the handle shaft 12. FIG. 7 illustrates a cross-sectional view of the device as it is wrapped approximately around 40 percent of the handle shaft 12. The side edge 46 of the grip insert tapers to a relatively thin edge to reduce any interfacing discontinuities between such edge and the handle shaft 12. In this manner, it appears to the feel of a user that the hand is gripping a single object rather than the handle 12 together with the power grip insert 10.

Figure 8:
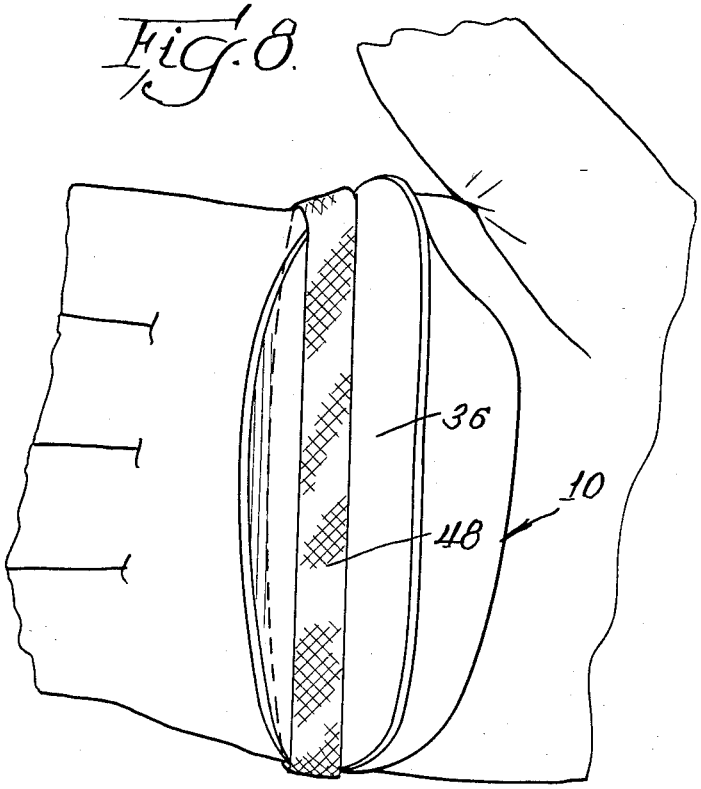
FIG. 8 shows the power grip device according to the present invention fastened to a user's hand by a woven cloth strap.
Figure 9:
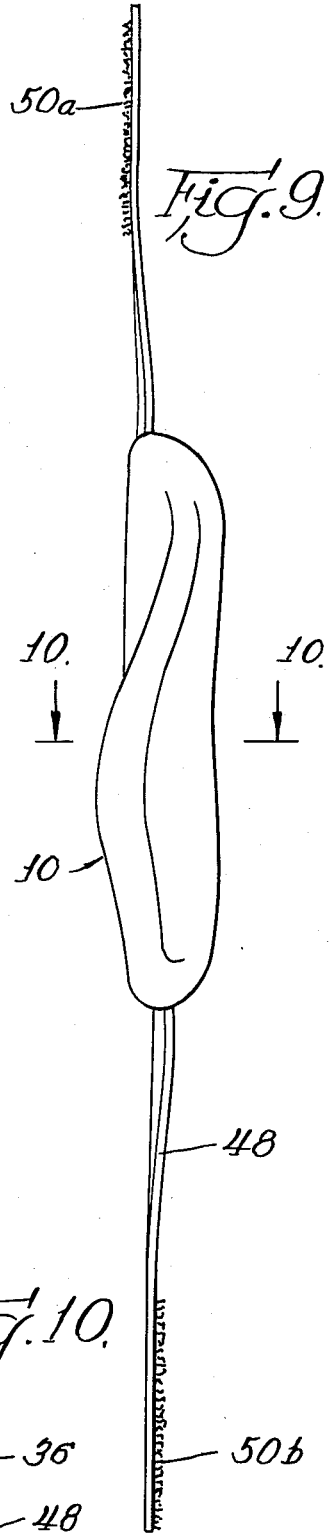
FIG. 9 is an edge view of the power grip device with Velcro strips at the ends of the woven strap.
Figure 11:
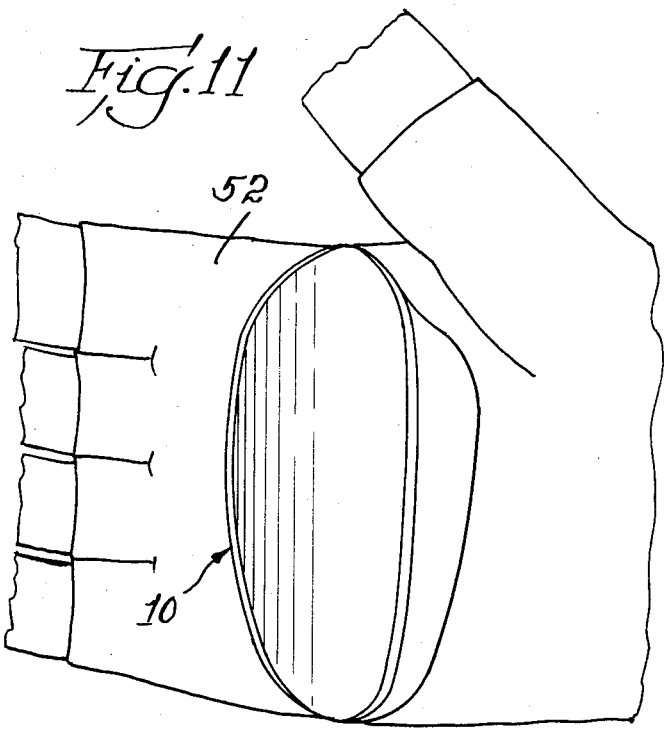
FIG. 11 shows a power grip device permanently fixed to the palm of a golfer's glove.
Figure 10:
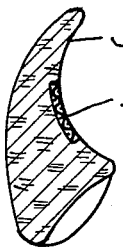
FIG. 10 is a cross-sectional view, taken along line 10—10 of FIG. 9, showing the woven strap embedded into the shank engaging surface of the power grip device.

Having set forth the construction of the power grip device 10, reference should now be directed to FIG. 8 where there is shown one method for removably attaching the device 10 to the user's hand. According to this method, a woven cloth strap 48 is imbedded into the surface of insert 10 during the formation process. The woven strap 48 is imbedded within the insert 10 and along the length of the cylindrical depression 36. FIG. 10 shows a cross-sectional view of FIG. 9 with the outer surface of the woven strap 48 being flush with the cylindrical shaft handle surface 36. Because of the flush nature of these elements a compromise in the gripping action of the power grip insert 10 with the shaft handle 12 is not made. FIG. 9 shows that the ends of the woven strap 48 include matable Velcro-like strips 50*a*, 50*b* for attaching the ends of the strap 48 together on the backside of the hand. Velcro strip 50*a* is attached to the strap 48 on one side whereas strip 50*b* is fastened to the other side of the strap so that each such strap can be attached together on the backside of the user's hand. The Velcro-like material is particularly suitable as it is easily adjusted to different sized hands, and affords a way to easily and quickly remove the power grip insert 10. While nylon woven straps may be used, other types of straps, such as an elastic type strap, may be used to provide a tensioned attachment of the grip insert 10 to the hand. While there exists various ways to attach the device 10 to a handled instrument, or to a glove, the device may also be used as a separate item without any means of attachment. When used with a glove 52 as shown in FIG. 11, such as commonly worn by golfers, the device 10 can be cemented to the glove itself, or formed as part of it during manufacture.

Another expedient method of attaching the power grip insert 10 to the hand is by surgical glue which can be applied to the palmar surface of the power grip insert and therefore easily attach or remove the grip insert 10 from the palm of a user's hand.

Although the preferred embodiments of the invention have been described in detail, it should be understood that various changes, substitutions and alterations can be made therein by those skilled in the art without departing from the spirit and scope of the invention as defined by the appended claims.

What is claimed is:

1. A hand grip device for use in gripping an instrument having a handle shaft, comprising:

insert means for filling the space between the palm of a hand and said handle shank, said insert means having (a) a first surface area contoured to conform to the palm of a hand, said surface area including a first and second dished supporting area which are angled with respect to each other at about 149 degrees and are each contoured respectively to the thenar and hypothenar eminence musculature of the hand with the hand in a relaxed state, and (b) a second surface area contoured to conform to the handle shank of said instrument.

2. The grip device of claim 1 wherein said first supporting area is contoured with an arc of about 47 mm, said arc being subscribed on each side of a line disposed about 30 degrees from the axial axis of the second dished supporting area.

3. The grip device of claim 1 wherein said second supporting area is contoured with an arc of about 50 mm, said arc being subscribed in a plane generally parallel to the axis of said second surface area receiving the handle shank.

4. The grip device of claim 1 wherein said first dished supporting area is separated from said second supporting area by a raised bridging portion supporting the palmar arch which bridging portion is rounded along a direction parallel to the axial axis of said second surface area, said rounding having a radius of about 145 mm.

5. The grip device of claim 1 wherein said first supporting area is dished with an arc of about 47 mm, said arc being subscribed in a plane which is transverse to the axial axis of said second surface area.

6. The grip device of claim 1 wherein said insert is separate from the handle and further includes a strap fixed to said insert and adapted to be wrapped around the user's hand so as to removably attach said insert within the palm of said hand.

7. A grip device for use in gripping a handled instrument, comprising a resilient insert fittable into the palm of a user's hand clenched around the handle of said instrument, said insert having a first surface area contoured according to the musculature of said palm, and an opposing surface area contoured according to the shape of said instrument handle and further including glove means having a portion thereof disposed in the palm of said hand between the first surface area of said device and the palm, and means for attaching said insert means thereat on said glove.

* * * * *